United States Patent [19]

Järvinen Uro T.

[11] 4,266,356

[45] May 12, 1981

[54] DEVICE FOR PREVENTING UNAUTHORIZED USE OF A FIREARM

[76] Inventor: Järvinen Uro T., Sätunavägen 18, 195 00 Märsta, Sweden

[21] Appl. No.: 16,078

[22] Filed: Feb. 28, 1979

[30] Foreign Application Priority Data

Mar. 2, 1978 [SE] Sweden ..... 7802389

[51] Int. Cl.[3] ..... F41C 27/00

[52] U.S. Cl. ..... 42/1 LP

[58] Field of Search ..... 42/1 LP

[56] References Cited

U.S. PATENT DOCUMENTS

| | | | |
|---|---|---|---|
| 2,530,560 | 11/1950 | Young | 42/1 LP |
| 2,997,802 | 8/1961 | Robbins | 42/1 LP |
| 3,089,272 | 5/1963 | McKinlay | 42/1 LP |
| 3,765,115 | 10/1973 | Johansson et al. | 42/1 LP |

*Primary Examiner*—Charles T. Jordan

*Attorney, Agent, or Firm*—Fleit & Jacobson

[57] ABSTRACT

A device for preventing unauthorized use of a firearm comprises a plug adapted to be inserted at least partially into a cartridge chamber in a barrel of a firearm, a locking member which is movably connected to the plug and adapted to be inserted into a recess in the wall of a rearwardly extending integral portion of the barrel to prevent removal of the plug from the cartridge chamber by acting against a rear wall of said recess, and a lock by which the locking member may be locked in relation to the plug in a position in which it projects into said recess.

2 Claims, 4 Drawing Figures

DEVICE FOR PREVENTING UNAUTHORIZED USE OF A FIREARM

The present invention relates to a device for preventing unauthorized use of a firearm. More particularly, the invention relates to such a device of the kind comprising a plug which is adapted to be inserted at least partially into a cartridge chamber in a barrel of a firearm, and means for locking the plug in a position in which it projects into said chamber.

A device of said kind is previously known, where the plug is intended to be held in position in the cartridge chamber by means of lockable expansion means acting against the wall of said chamber. However, said device is unfavorable in several respects. Firstly, it is not possible to lock the plug to the barrel in a safe and reliable manner by means of such expansion means. The difficulties encountered in this connection are especially pronounced when the cartridge chamber is slightly widened towards its rear end, as usually is the case. Additionally, in practice, it is almost impossible to mount such a device in a firearm unless the entrance opening to the cartridge chamber can be fully uncovered, which, for many firearms, cannot be done without first removing the barrel completely from the remainder of the firearm.

The invention has for its object to provide an improved device of the kind initially specified which makes it possible to secure the plug to the barrel in a very efficient manner and permits an insertion of the plug into and a removal thereof from the cartridge chamber both when the barrel is mounted in the firearm as well as when it has been removed therefrom.

According to the invention, for this purpose, there is provided a device of said kind, wherein the locking means for the plug comprise a locking member which is movably connected to the plug and adapted to be inserted into a recess in the wall of a rearwardly extending integral portion of the barrel to prevent removal of the plug from the cartridge chamber by acting against a rear wall of said recess, and a lock by means of which the locking member may be locked in relation to the plug in a position in which it projects into said recess.

The proposed device is suited to be used in various types of guns or other firearms having a barrel which is provided with a rearwardly extending integral portion of open cross-section formed with a recess in which a locking member of the bolt of the firearm may be inserted to lock the bolt in its firing position. The proposed provision of a locking member on the device which may be inserted into said recess and locked therein makes it possible to secure the plug to the barrel in an efficient manner and to mount the device in the barrel and remove it therefrom in a rapid and easy fashion both when the barrel is mounted in the firearm and when it has been removed therefrom.

Figure 1:
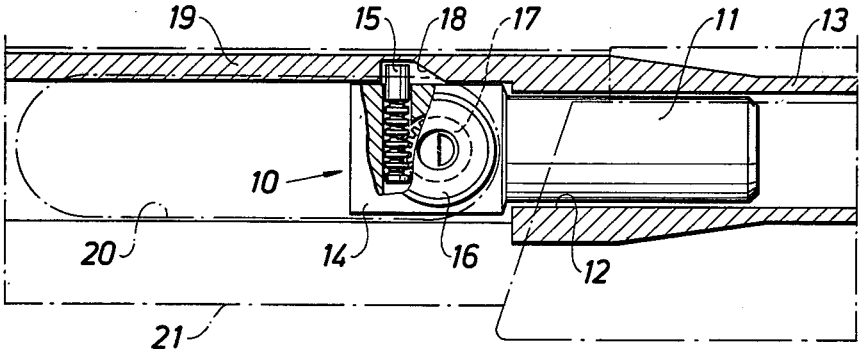
Figure 2:
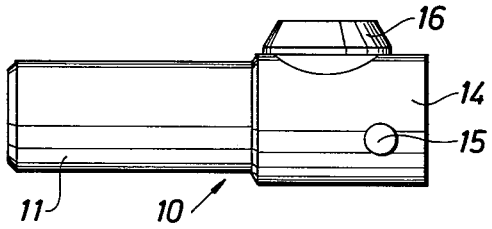
Figure 3:
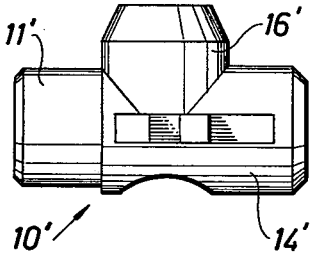
Figure 4:
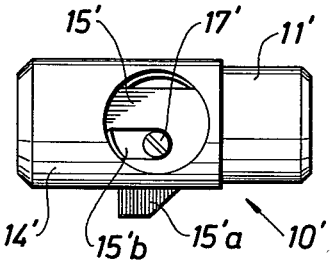

Below the invention will be described in greater detail, reference being had, by way of example to the accompanying drawing, in which:

FIG. 1 is a top plan view of a device according to a first embodiment of the invention, showing the device when inserted in the cartridge chamber of a barrel of a gun and locked to the barrel, portions of the device being cut away for the purpose of clarification, FIG. 2 is a side elevation of the device according to FIG. 2, FIG. 3 is a side elevation, corresponding to FIG. 3, of a device according to a second embodiment of the invention, and FIG. 4 is a bottom plan view of the device according to FIG. 3.

The device generally designated 10 in FIGS. 1 and 2 comprises a body consisting of a cylindrical front portion 11, forming a plug which is adapted to be inserted into the cartridge chamger 12 of the barrel 13 of a gun or other firearm, and a rear generally cylindrical portion 14 of slightly increased diameter. Reference numeral 15 designates a locking pin which is mounted in portion 14 for displacement thereof in a direction perpendicular to the longitudinal axis of the body between a retracted position and an extended position, shown in FIG. 1, in which it projects partially from the body of the device. Pin 15 may be moved between its said positions by means of a lock consisting of a cylinder lock of disc type, comprising an outer cylinder or housing 16 which is rigidly secured to portion 14 of the body, and an inner cylinder which is rotatable within the outer cylinder by means of a key and which is coupled to pin 15 by means of a toothed wheel 17 provided in meshing engagement with a series of axially interspaced ridges on pin 15 defined between annular grooves in the outer surface of said pin. The outer end portion of pin 15 forms a locking member which may be inserted into a recess 18 in the inner wall of an open cross-section portion 19 of barrel 13 extending in a rearward direction from the cartridge chamber 12 to lock the body of the device in the position shown in FIG. 1, wherein the front portion 11 of the body extends into cartridge chamber 12. When the device 10 has been locked to the barrel in the position shown in FIG. 1, it will efficiently prevent any unauthorized use of the firearm.

The device 10 may be mounted in the barrel 13 when the latter is removed from the reminder of the firearm as well as when the barrel is mounted in the firearm. In the latter case, the device 10 may be inserted into and removed from the firearm through an ejection opening 20 in the wall of a casing 21 of the firearm, said opening and said casing being shown in dash-dotted lines in FIG. 1. When the barrel is mounted in the firearm, device 10 may also prevent removal of barrel 13 from the firearm as the outer cylinder or housing 16 of the lock will form a stop cooperating with an abutment formed by the front edge of the ejection opening 20 of casing 21.

In FIGS. 3 and 4 details corresponding to those shown in FIGS. 1 and 2, have been identified by the same reference numerals, however, with the addition of a prime. The embodiment shown in FIGS. 3 and 4 differs from the embodiment illustrated in FIGS. 1 and 2 substantially only in that the cylindrical pin 15 has been replaced by a plate 15' which is slidably received in a transversally extending slot-shaped opening in body portion 14'. As can best be seen from FIG. 4, plate 15' is provided with a lateral projection 15'a which is adapted to fit into the recess 18 in the rearwardly extending portion 19 of barrel 13. As can be seen from FIG. 4, plate 15' is provided with a elongated opening 15'b wherein the head of a screw 17' is received to permit lateral movement of plate 15' from the position shown in FIG. 4 to a fully retracted position through rotation of the inner cylinder of the cylinder lock, into which said screw 17' is threaded.

The invention is not restricted to the embodiments above described and shown in the drawing. Thus, many other alternative embodiments are feasible within the scope of the invention. For instance, the locking member formed by pin 15 or plate 15', respectively, may be replaced by a locking member which is pivotally connected to the body of the device.

It should be noted that recess 18 need not be specially provided in portion 19 of barrel 13 to facilitate an application of the device proposed. Instead, the device is intended to be utilized in connection with firearm barrels which are provided with a recess, corresponding to recess 18, for receiving a locking member of the bolt of the firearm serving to lock the bolt in its firing position.

I claim:

1. A device for preventing unauthorized use of a firearm, said device comprising a plug which is adapted to be inserted at least partially into a cartridge chamber in a barrel of a firearm and locking means for locking the plug in a position in which it projects into said chamber;

said locking means comprising a locking member which is slidably mounted in the plug or a portion rigidly connected thereto for displacement in a direction substantially perpendicular to the longitudinal axis of the plug between an inoperative or retracted position, in which it permits an unimpeded insertion of the plug into the cartridge chamber as well as an unimpeded removal of the plug from said chamber, and an operative or extended position, in which it is adapted to project into a recess in the wall of a rearwardly extending integral portion of the barrel to prevent removal of the plug from the cartridge chamber by acting against a rear wall of said recess, said locking means further comprising a lock, by means of which the locking member may be locked in relation to the plug in its said operative or extended position.

2. A device according to claim 1, comprising means adapted to prevent removal of the barrel from the remainder of the firearm.

* * * * *